US006315621B1

(12) United States Patent
Natori et al.

(10) Patent No.: US 6,315,621 B1
(45) Date of Patent: Nov. 13, 2001

(54) ELECTRICAL CONNECTOR CONTACT ELEMENT HAVING MULTI-CONTACT POINTS TO COME INTO CONTACT WITH A SINGLE MATING CONTACT ELEMENT WITH INDEPENDENT CONTACTING FORCES

(75) Inventors: Akira Natori, Fussa; Junichi Sato, Fujiyoshida, both of (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/506,514

(22) Filed: Feb. 17, 2000

(30) Foreign Application Priority Data

Feb. 18, 1999 (JP) ..... 11-039897

(51) Int. Cl.[7] ..... H01R 4/48
(52) U.S. Cl. ..... 439/862
(58) Field of Search ..... 439/862, 636, 439/637, 404, 65, 66, 591

(56) References Cited

U.S. PATENT DOCUMENTS

| | | | | |
|---|---|---|---|---|
| 3,199,066 | * | 8/1965 | Eledge et al. | 439/636 |
| 3,233,208 | * | 2/1966 | Ruehlemann et al. | 439/636 |
| 3,394,454 | * | 7/1968 | Logan | 439/404 |
| 3,474,380 | * | 10/1969 | Miller | 439/862 |
| 6,077,130 | * | 1/2000 | Hughes et al. | 439/862 |
| 6,113,440 | * | 9/2000 | Fijten | 439/862 |
| 6,126,496 | * | 10/2000 | Shinozaki | 439/862 |

FOREIGN PATENT DOCUMENTS

| | | |
|---|---|---|
| S56-5255 | 2/1981 | (JP) . |
| S61-44778 | 3/1986 | (JP) . |

* cited by examiner

*Primary Examiner*—Gary Paumen
*Assistant Examiner*—Alexander Gilman
(74) *Attorney, Agent, or Firm*—Laff, Whitesel & Saret, Ltd.; J. Warren Whitesel

(57) ABSTRACT

A contact element (51) is made of an elastic metal plate and comprises a fixing portion (53) to be fixed to an insulator (230), an elastic arm portion (55) connected to the fixing portion (53), and a contacting elastic portion (57) connected to the elastic arm portion (55). The contacting elastic portion (57) has contact points (91, 93) to be brought into contact with a mating contact surface (501) of a mating contact element. The elastic arm portion (55) and the contacting elastic portion (57) have a plurality of elastic finger portions (101, 103) displaceable independently of each other. The elastic finger portions (101, 103) have different size in a width direction of the elastic metal plate. When the contact points (91, 93) are pressed by the mating contact element, the elastic arm portion (55) is deformed and displaced while the contacting elastic portion (57) is displaced under a predetermined load ratio kept between the elastic finger portions (101, 103) so that the contact points (91, 93) are brought into contact with the mating contact with a predetermined contacting force ratio maintained therebetween.

5 Claims, 6 Drawing Sheets

ELECTRICAL CONNECTOR CONTACT ELEMENT HAVING MULTI-CONTACT POINTS TO COME INTO CONTACT WITH A SINGLE MATING CONTACT ELEMENT WITH INDEPENDENT CONTACTING FORCES

BACKGROUND OF THE INVENTION

This invention relates to an electrical connector having an insulator and at least one contact element fixed to the insulator and, in particular, to such an contact element used in the electrical connector and having multi-contact points to come into contact with a single mating contact element.

A first existing contact element of the multi-contact-point type is made of an elastic metal plate and comprises a fixing portion and an elastic portion extending from the fixing portion. The elastic portion is provided with an elongated hole formed at a position near to its one end and extending in a longitudinal direction thereof. A pair of contact points are formed on the elastic portion at both sides of the elongated hole. The contact points are brought into contact with a mating contact element in common.

A second existing contact element has two elastic finger portions which are formed by forming not the elongated hole but a slit in the elastic portion. The slit extends from the one end of the elastic portion towards the fixing portion so that the two elastic finger portions are in parallel with each other and symmetric to each other in relation to the slit. Two contact points are formed on middle positions of the two elastic finger portions, respectively. An example of the second existing contact element is disclosed in Japanese Examined Utility Model Publication (JP-Y) No. S56-5255 (5255/1981).

A third existing contact element has a bent finger portion formed at a intermediate position of the elastic portion in its extending direction by cutting and bending technique. Two contact points are formed on an end of the bent finger portion and an end of the elastic portion, respectively, so that the two contact points are located at offset positions in the extending direction of the elastic portion. An example of the second existing contact element is disclosed in Japanese Unexamined Utility Model Publication (JP-U) No. S61-44778 (44778/1986).

However, in the first existing contact, the contact points are synchronously displaced when they are brought into contact with a mating contact element. In other words, the contact points are not independently displaced with respect to each other. Therefore, if the mating contact is inclined or if the mating contact has an irregular surface, two contact points cannot follow the inclination or irregularity when the contact points are brought into contact with the mating contact. Thus, it is difficult to maintain a state where two contact points are reliably brought into contact with the mating contact.

In the second existing contact element, the two elastic finger portions are separated from each other by the slit. Therefore, two contact points formed on the finger portions are generally displaceable independently to each other so that they can be brought into contact with the mating contact element with independent contacting forces. Therefore, this second existing contact element has such a problem as in the first existing contact element.

However, the two elastic finger portions are same in material and have the same size, that is, similar in length, width and thickness. Therefore, two contact points are in contact with the mating contact element with the contacting forces equal to each other. On the other hand, two finger portions have the natural vibrating frequencies equal to each other. This results in that two elastic finger portions would simultaneously resonate to vibration applied thereto when the contact element is used under a condition where strong vibration and/or shock is applied to the contact element. This leads an undesired condition where electrical connection would be broken between the two contact points and the mating contact element.

In the third existing contact element, the contact points depend upon each other in behavior and each of the contact points is displaceable within a restricted range when they are brought into contact with the mating contact element. Specifically, the bent finger portion having one of the contact points is supported by the elastic potion having the other of the contact points. Therefore, a contacting force between one of the contact points and the mating contact element affects another contacting force between the other one of the contact points and the mating contact element. Therefore, it is difficult to maintain a stable and reliable contact between the contact points and the mating contact element.

SUMMARY OF THE INVENTION

It is an object of this invention to provide a contact element of a multi-contact-point type in which a plurality of contact points can keep a stable and reliable contact with a mating contact element with a predetermined contacting force ratio and irrespective of variation in displacement.

It is another object of this invention to provide a contact element of the multi-contact-point type which is capable of avoiding occurrence of an electrically discontinuous contacting state with the mating contact element even if it is subjected to intense external vibration or shock.

It is still another object of this invention to provide a contact element which is capable of improving the stability and the reliability of a contacting state even in an oily, a dusty, or a gassy environment.

According to this invention, there is provided an electrical connector contact element made of an electroconductive elastic plate and comprising a fixing portion to be fixed to an insulator and having a first end, an elastic portion with a second end connected to the first end of the fixing portion and having a third end opposite to the second end, the elastic portion being formed with at least one slit extending from the third end towards the second end to thereby form a plurality of elastic finger portions, and a plurality of contact points formed on the finger portions, respectively, for coming into contact with a common mating contact element, wherein the plurality of elastic finger portions have widths, respectively, which are at least partially different from each other.

DESCRIPTION OF THE PREFERRED EMBODIMENT

In order to facilitate an understanding of this invention, description will at first be made about existing contacts with reference to FIGS. 1 through 4.

Figure 1:
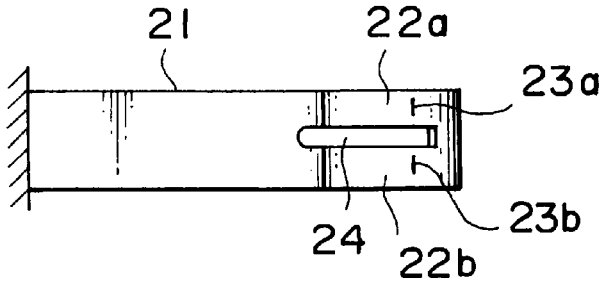
FIG. 1 PRIOR ART
FIG. 1 is a plan view of a first existing contact element.
Figure 2:
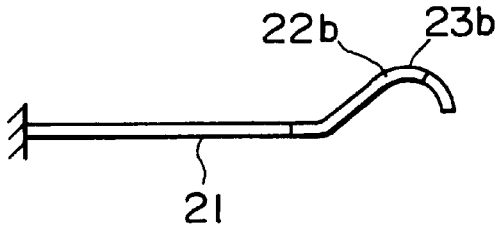
FIG. 2 PRIOR ART
FIG. 2 is a side view of the contact element illustrated in FIG. 1.

Referring to FIGS. 1 and 2, a first existing contact element 21 of the multi-contact type is formed into an elastic metal strip by cutting and bending an elastic metal plate, which comprises an end portion as a fixing portion and an elastic cantilevered portion extending therefrom to an opposite free end. The elastic cantilevered portion is curved in the vicinity of the free end as seen in FIG. 2, and is provided with an elongated hole 24 at the curved portion. The elongated hole 24 extends in the longitudinal direction at the center in a widthwise direction of the elastic cantilevered portion. Thus, the elastic cantilevered portion has two contacting sections 22*a* and 22*b* separated by the elongated hole 24. The contacting sections 22*a* and 22*b* have contact points 23*a* and 23*b* thereon, respectively, which are brought into contact with a mating contact element (not shown).

However, the first existing contact element 21 has problems as described in the preamble.

Figure 3:
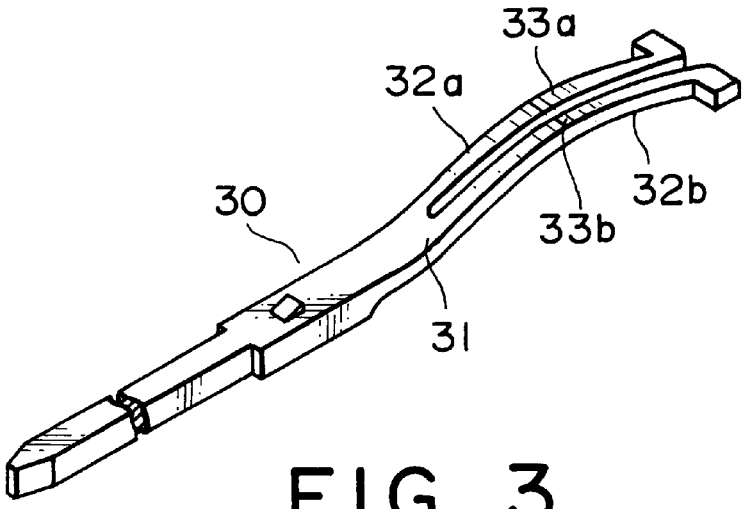
FIG. 3 PRIOR ART
FIG. 3 is a perspective view of a second existing contact element.

Referring to FIG. 3, a second existing contact element 30 of the multi-contact type is also formed in an elastic metal strip having a fixing portion and an elastic cantilevered portion 31, which is similar to contact element in FIG. 1. The elastic cantilevered portion is slightly curved in the vicinity of the free end thereof. The elastic cantilevered portion is formed with not an elongated hole but a slit extending from the free end towards the fixing portion over the curved portion at the center in the width of the cantilevered portion 31. Therefore, the elastic cantilevered portion 31 has a pair of elastic finger portions or contacting portions 32*a* and 32*b* individually extending in parallel to each other and symmetric to each other in relation to the slit. The contacting portions 32*a* and 32*b* are equal in length and width to each other. The contacting portions 32*a* and 32*b* have contact points 33*a* and 33*b* formed at their intermediate positions, respectively.

Figure 4A:
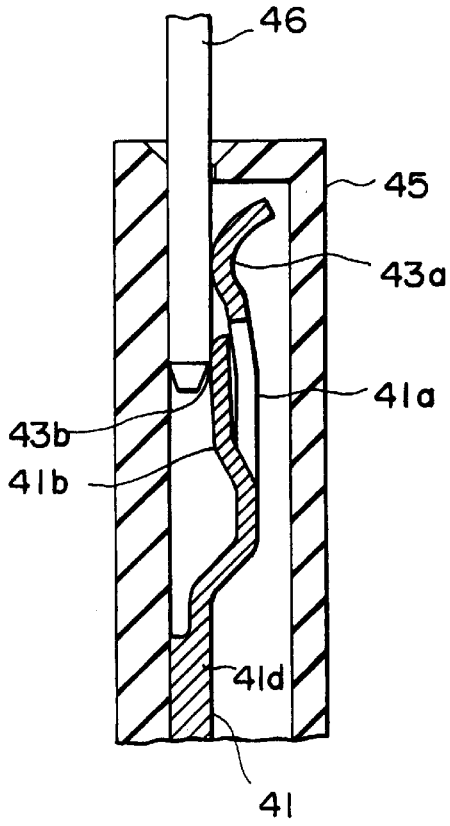
FIG. 4A PRIOR ART
FIG. 4A is a partially-sectional side view of a third existing contact element fixed to an insulator.
Figure 4B:
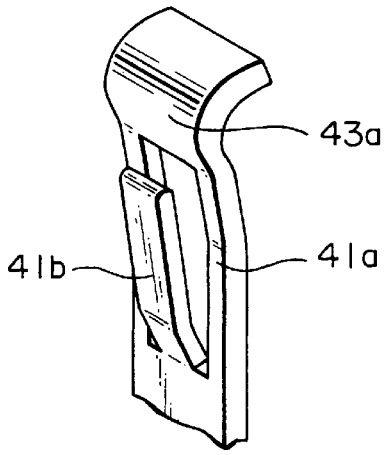
FIG. 4B PRIOR ART
FIG. 4B is a perspective view of the contact element shown in FIG. 4A.
Figure 5:
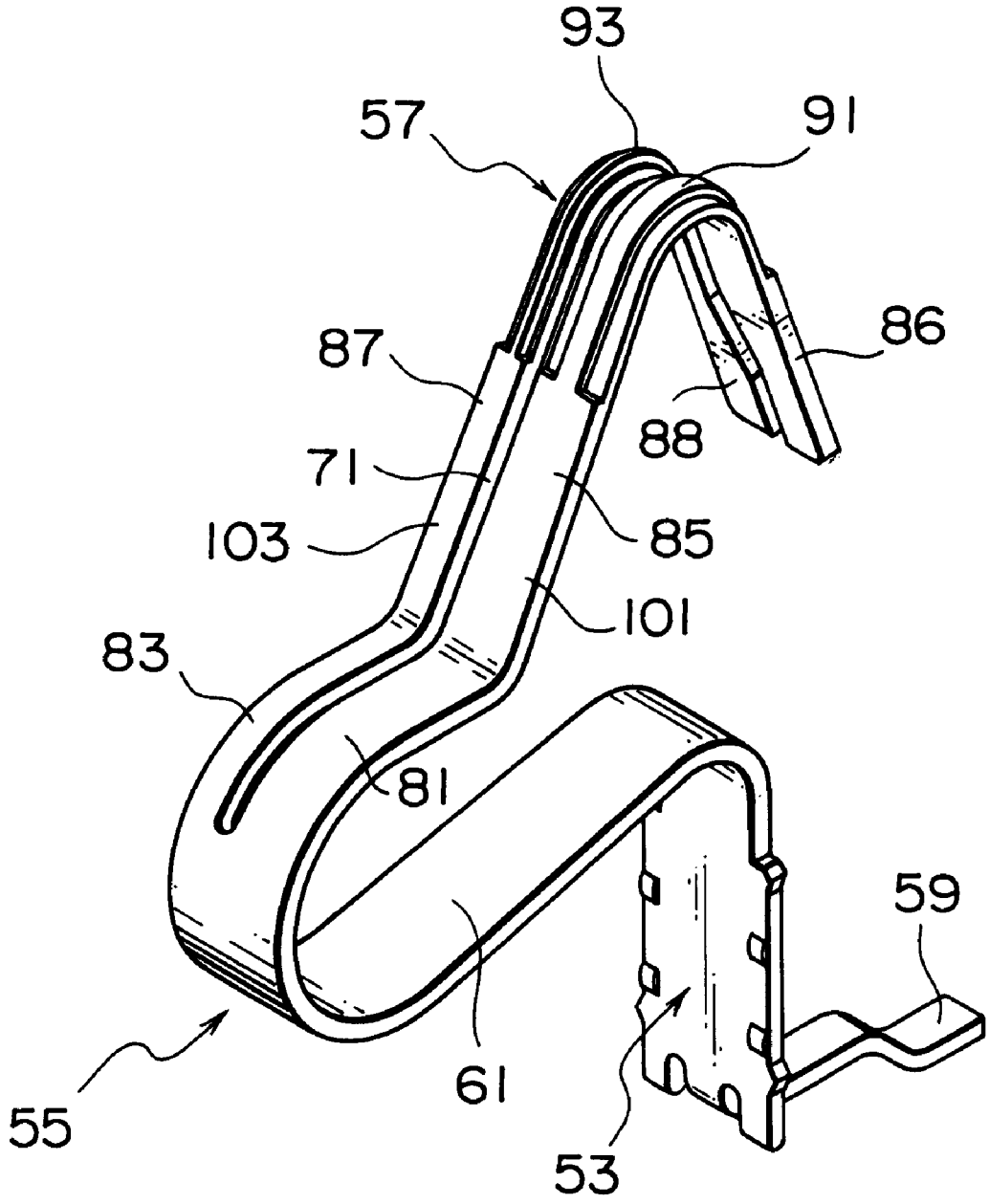
FIG. 5 is a perspective view of a contact element according to one embodiment of this invention.
Figure 6:
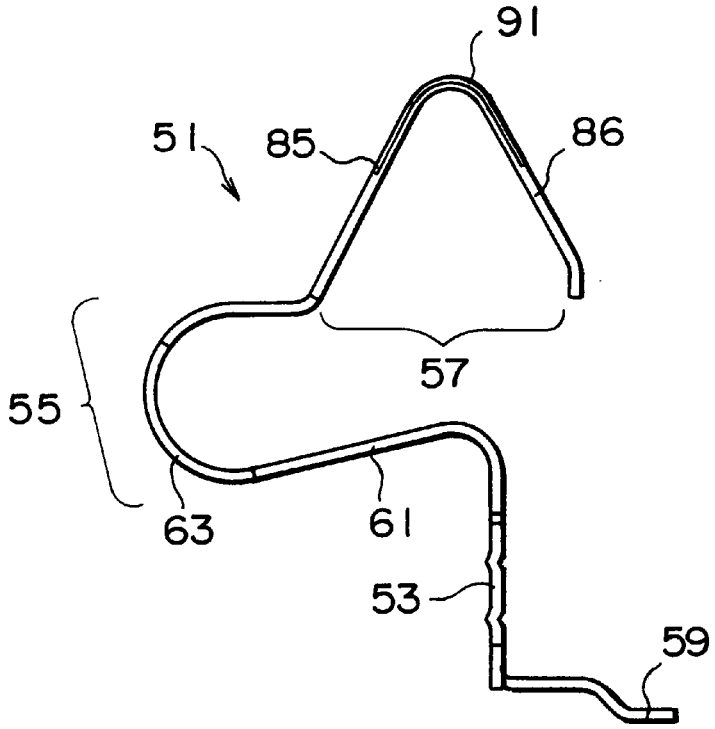
FIG. 6 is a side view of the contact element illustrated in FIG. 5.
Figure 7:
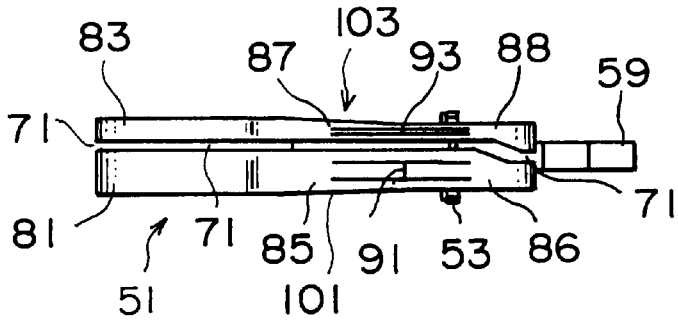
FIG. 7 is a plan view of the contact illustrated in FIG. 5.
Figure 8:
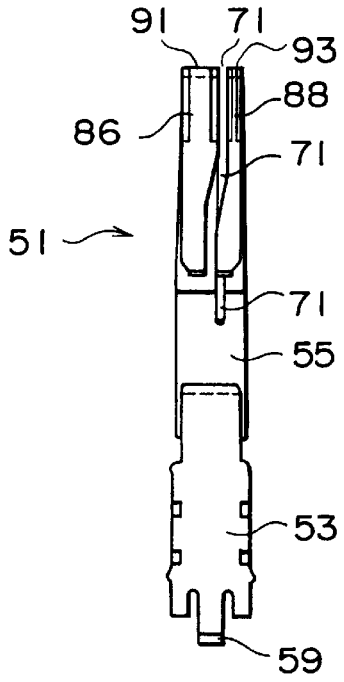
FIG. 8 is a right side view of the contact illustrated in FIG. 5.

Referring to FIGS. 4A and 4B, a third existing contact element 41 of the multi-contact type is also formed in an elastic metal strip having a fixing portion 41*d* and an elastic cantilevered portion 41*a*. The elastic cantilevered portion 41*a* is slightly curved in the vicinity of a continuous portion with the fixing portion 41*d* and is curved in the vicinity of the free end thereof, as shown in the figures. The elastic cantilevered portion 41*a* is further cut and bend at its intermediate position in its extending direction to form a bent finger 41*b*. Two contact points 43*a* and 43*b* are formed at the curved portion in the vicinity of the elastic cantilevered portion 41*a* and at an extending end portion of the elastic finger 41*b*, respectively, to be brought into contact with a common mating contact element 46. The contact points 43*a* and 43*b* of the cantilevered portions 41*a* and the elastic finger 41*b* are offset from each other in the extending direction of the cantilevered portion 41*a*.

In FIG. 4A, the contact element 41 is shown as being fixed to an insulator 45.

In the third existing contact element 41, the lengths of the cantilevered portion 41*a* and the elastic finger 41*b* having the contacts points 43*a* and 43*b* are different from each other and the latter is supported by the former.

The third existing contact element 41 has problems as described in the preamble.

Now, description will be made in detail about one embodiment of this invention with reference to the drawing.

Referring to FIGS. 5–8, a contact element 51 of the multi-contact type according to one embodiment of this invention comprises a fixing portion 53 to be fixed to an insulator (not shown), an elastic arm portion 55 connected to one end of the fixing portion 53, a contacting elastic portion or an elastic contact portion 57 connected to the elastic arm portion 55, and a terminal portion 59 connected to the other end of the fixing portion 53.

The elastic arm portion 55 and the contacting elastic portion 57 is an elastic portion continuous to, or jointed at, or supported by, the one end of the fixing portion 53. The fixing portion 53 and the elastic portion 55–57 are made of a metallic plate into one piece element.

In the embodiment shown, the elastic arm portion 55 is curved in a C-shape towards the fixing portion 53. The contacting elastic portion 57 is curved in a U-shape at the connection of the elastic arm portion 55 and the contacting elastic portion 57 in an direction opposite to the C-shape curve. The contacting elastic portion or elastic contact portion 57 is bent in a V-shape at an intermediate position therealong in a direction opposite to the U-shape curve, as shown in those figures.

The contact element 51 comprises an elastic plate formed by punching and cutting an electroconductive flat-plate material having elasticity, or an elastic metal plate, by the use of a cutting apparatus such as a punch press. To form the contact element 51, the elastic plate is bent in its thickness direction at a plurality of positions at predetermined angles.

The contacting elastic portion 57 is located above the one end of the fixing portion 53 in its axial direction. The elastic arm portion 55 connects the fixing portion 53 and the contacting elastic portion 57 to each other.

Specifically, the elastic arm portion 55 comprises a base section 61 extending from the one end of the fixing portion 53 in a direction substantially perpendicular to the axial direction of the fixing portion 53, and a curved section 63 extending from one end of the base section 61 and bent into a C-shape towards a position above the one end of the base section 61.

The elastic arm portion 55 serves to allow the displacement of the contacting elastic portion 57 when the contacting elastic portion 57 is pressed by a mating contact (not shown) towards the fixing portion 53.

The contacting elastic portion 57 is formed with a long slit 71 extending from a free end of the contacting elastic portion 57 to the curved section 63 of the elastic arm portion 55.

Thus, the curved section 63 and the contacting elastic portion 57 are divided into two pieces by the slit 71. One of the two pieces is shown generally larger than the other in the width direction of the elastic plate of the contact element 51. The former and the latter will be referred to as a primary one and a subsidiary one, herein after. Specifically, the curved section 63 has a primary separate piece or section 81 and a subsidiary separate piece or section 83. The contacting elastic portion 57 has a primary and subsidiary finger portions.

The primary finger portion comprises two sections corresponding to two legs of V-shape, that is a first primary leg section 85 connected to one end of the primary separate section 81 and a second primary leg section 86 connected to one end of the first primary leg section 85. The subsidiary finger portion comprises a first subsidiary leg section 87 connected to one end of the subsidiary separate section 83 and a second subsidiary leg section 88 connected to one end of the first subsidiary leg section 87.

The first primary leg section 85 extends from the one end of the primary separate section 81 obliquely upward to be gradually separated from a plate surface of the base section 61. The second primary leg section 86 is connected to the first primary leg section 85 and extends obliquely downward to face the first primary leg section 85 and to be gradually separated from the first primary leg section 85. Thus, the first and the second primary leg sections 85 and 86 forms a generally inverted-V shape.

At a junction between the first and the second primary leg sections 85 and 86, a primary contact point 91 is formed arcuate.

The first subsidiary leg section 87 also extends from the one end of the subsidiary separate section 83 obliquely upward to be gradually separated from the plate surface of the base section 61. The second subsidiary leg section 88 is connected to the first subsidiary leg section 87 and extends obliquely downward to be gradually separated from the first subsidiary leg section 87. Thus, the first and the second subsidiary leg sections 87 and 88 also forms a generally inverted-V shape.

At a junction between the first and the second subsidiary leg sections 87 and 88, a secondary contact point 93 is also formed arcuate.

A combination of the primary separate section 81 and the first and the second primary leg sections 85 and 86 forms a primary elastic finger portion 101. Similarly, a combination of the subsidiary separate section 83 and the first and the second subsidiary leg sections 87 and 88 forms a subsidiary elastic finger portion 103.

The primary and the subsidiary elastic finger portions 101 and 103 are separated by the slit 71 to be substantially different in width from each other. Specifically, the primary and the subsidiary elastic finger portions 101 and 103 are substantially equal in width to each other in the vicinity of the free ends of the second primary leg section 86 and the second subsidiary leg section 88, in detail, in a region between the free ends and a generally middle point of the second primary leg section 86 and the second subsidiary leg section 88. Except the vicinity of the free ends of the second primary leg section 86 and the second subsidiary leg section 88, the primary elastic finger portion 101 is greater in width than the secondary elastic finger portion 103.

Figure 9:
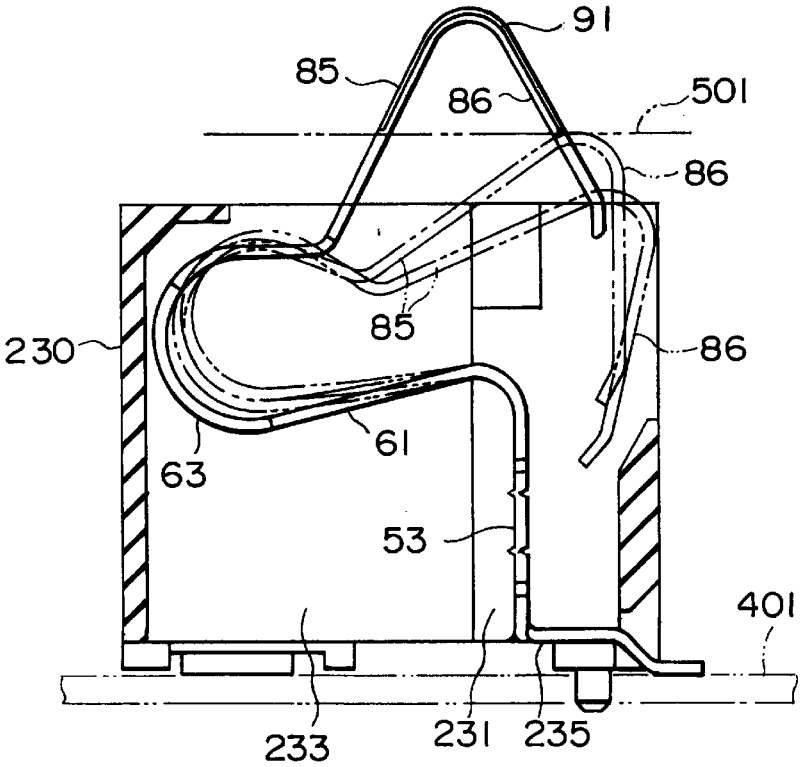
FIG. 9 is a partially-sectional side view of the contact in FIG. 5 fixed to an insulator.

Referring to FIG. 9, the contact element 51 is fixed to an insulator 230 to form an electrical connector.

As illustrated in FIG. 9, the insulator 230 has a shape of a hollow box.

Within the insulator 230, the fixing portion 53 of the contact element 51 is press-fitted into a vertical wall 231 of the insulator 230 to be fixedly supported. The elastic arm portion 55 is received in a cavity 233 of the insulator 230 to be freely deformable and displaceable.

The most part of each of the first and the second primary leg sections 85 and 86 and the first and the second subsidiary leg sections 87 and 88 protrudes outward from an upper surface of the insulator 230 except the opposite ends thereof, i.e., the both ends of the contacting elastic portion 57. The free ends of the second primary leg section 86 and the second subsidiary leg section 88 are slightly inserted into the cavity 233 to be freely movable.

The terminal portion 59 of the contact element 51 is arranged at a bottom 235 of the insulator 230 to extend outward of the insulator 230. For example, when the electrical connector is mounted on a substrate 401 such as a printed circuit board, the terminal portion 59 is connected to a circuit conductor on the substrate 401 by soldering.

In FIG. 9, only a mating contact surface 501 of the mating contact element is depicted by a two-dot-and-dash line. In addition, the displacement of the contacting elastic portion 57 is also illustrated by two-dot-and-dash lines.

It is assumed here that the mating contact element above the insulator 230 is pressed towards the upper surface of the insulator 230. In this event, each of the primary contact point 91 and the subsidiary contact point 93 is pressed downward by the mating contact surface 501 of the mating contact element. The elastic arm portion 55 is deformed and displaced so that a curvature of the C-shape curve is made small. At this time, the mating contact surface 501 greatly displaces the contacting elastic portion 57 downward to push the contacting elastic portion 57 into the cavity 233.

Thus, when the mating contact presses the contacting elastic portion 57, the elastic arm portion 55 is deformed and displaced and the contacting elastic portion 57 is displaced while a predetermined load ratio is kept between the primary and the subsidiary elastic finger portions 101 and 103. The primary and the subsidiary contact points 91 and 93 are brought into contact with the mating contact under a predetermined contacting force ratio maintained between the primary and the subsidiary contact points 91 and 93.

The primary and the subsidiary elastic finger portions 101 and 103 are separated by the slit 71 so that the primary and the subsidiary contact points 91 and 93 are brought into contact with the mating contact surface 501 of the mating contact independently of each other.

Thus, the primary and the subsidiary contact points 91 and 93 are brought into contact with the mating contact surface 501 with the predetermined load ratio maintained between the primary and the subsidiary elastic finger portions 101 and 103.

Figure 10:
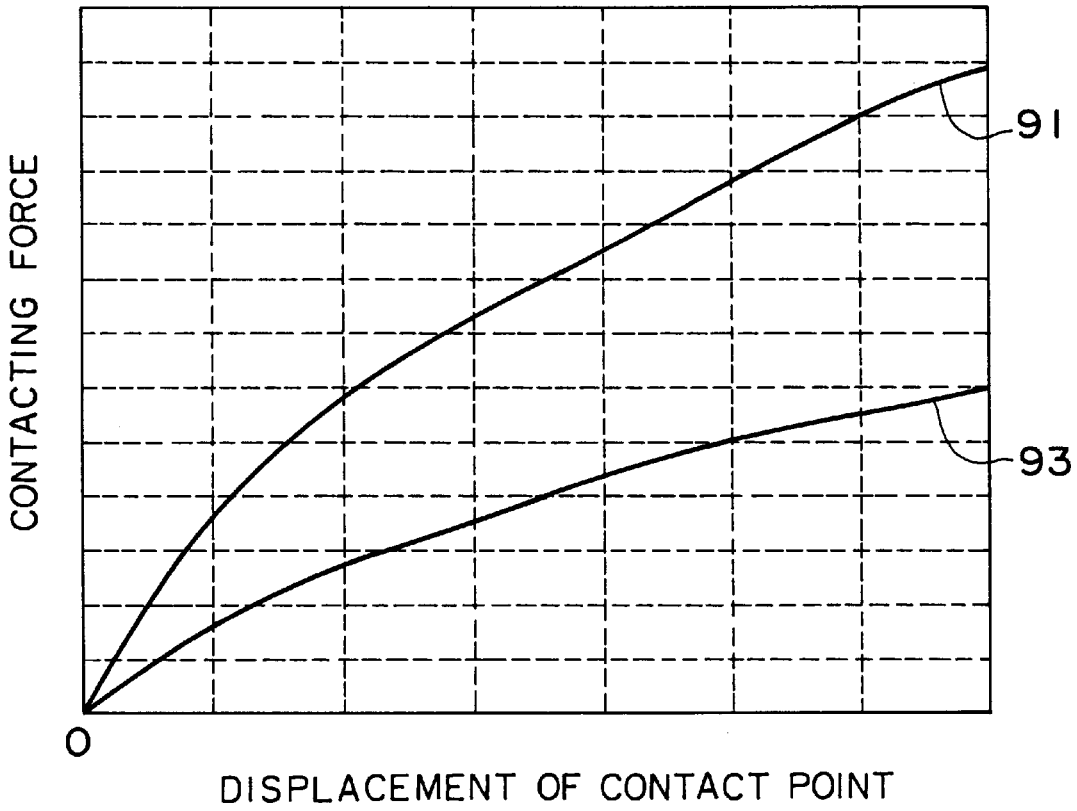
FIG. 10 is a graph showing a contacting force characteristic of the contact illustrated in FIG. 5.

Referring to FIG. 10, the primary and the subsidiary contact points 91 and 93 exhibit contacting force characteristics illustrated in the figure when they are brought into contact with the mating contact surface 501. In FIG. 10, an abscissa and an ordinate represent the displacement of each of the primary and the subsidiary contact points 91 and 93 and the contacting force, respectively.

As seen from FIG. 10, the contacting force of the primary contact point 91 of the primary elastic finger portion 101 having a greater width is greater than that of the subsidiary contact point 93 of the subsidiary elastic finger portion 103 having a smaller width. A predetermined contacting force ratio is kept between the primary and the subsidiary contact points 91 and 93 irrespective of variation in displacement.

The contact element 51 of this invention has the primary elastic finger portion 101 and the subsidiary elastic finger portion 103 different in contacting force. Therefore, the primary and the subsidiary elastic finger portions 101 and 103 mutually compensate their weak points in various environments where the contact element 51 is used. In addition, the primary and the subsidiary elastic finger portions 101 and 103 keep a stable and reliable contacting state with the predetermined contacting force ratio maintained between the primary and the subsidiary contact points 91 and 93 irrespective of variation in displacement.

Furthermore, the primary and the subsidiary elastic finger portions 101 and 103 have natural vibrating frequencies different from each other. Therefore, even if the contact element is subjected to intense vibration or shock, occurrence of an electrically discontinuous contacting state is avoided because resonance points of the primary and the subsidiary elastic finger portions 101 and 103 are different.

Specifically, the resonance point of each of the primary and the subsidiary elastic finger portions 101 and 103 is determined by its natural vibrating frequency which is determined by its elastic constant. In the contact element 51 of this embodiment, the primary and the subsidiary elastic finger portions 101 and 103 are different in elastic constant because they are different in width from each other. Therefore, even if the primary contact point 91 is released or separated from the mating contact surface 501 due to resonance of the primary elastic finger portion 101 resulting from external vibration, the subsidiary contact point 93 is kept in contact with the mating contact surface 501.

Furthermore, in the contact element 51 of this embodiment, the subsidiary contact point 93 smaller in contacting force serves to improve mechanical life against vibration, shock, and repetition of insertion/removal. On the other hand, the primary contact point 91 greater in contacting force serves to improve the stability and the reliability of the contacting state in various environments such as an oily environment, a dusty environment, and a gassy environment.

In the foregoing embodiment, the contact element 51 has the primary and the subsidiary elastic finger portions 101 and 103. However, the contact element 51 is not restricted to the structure having the two elastic finger portions. As will readily be understood, an additional elastic finger portion can be formed by providing a plurality of slits 71. In this event, the primary elastic finger portion 101, the subsidiary elastic finger portion 103, and the additional elastic finger portion must be different in width from one another.

What is claimed is:

1. An electrical connector contact element (51) made of an electroconductive elastic plate and comprising a fixing portion (53) to be fixed to an insulator (230) and having a first end, an elastic portion (55, 57) with a second end connected to the first end of said fixing portion (53) and having a third end opposite to the second end, said elastic portion (55, 57) being formed with at least one slit (71) extending from said third end towards the second end to form a plurality of elastic finger portions (101, 103), and a plurality of contact points (91, 93) formed on said finger portions (101, 103), respectively, for coming into contact with a common mating contact element, wherein said plurality of elastic finger portions (101, 103) have widths, respectively, which are at least partially different from each other, wherein said elastic portion (55, 57) comprises:

an elastic arm portion (55) having said second end connected to said first end of said fixing portion (53) and being smoothly bent with a C-shape curve towards said fixing portion (53), said elastic arm portion (55) having a fourth end portion opposite to said second end thereof, said fourth end portion comprising a plurality of separate pieces (81, 83) separated by said at least one slit; and an elastic contact portion (57) comprising said elastic finger portions (101, 103) connected to said separate pieces (81, 83), respectively, said elastic contact portion (57) being smoothly bent with a U-shape curve in a direction opposite to said C-shape curve and being further bent with a V-shape curve in a direction of said U-shape curve, said contact points being formed on the V-shape curve.

2. An electrical connector contact element as claimed in claim 1, wherein a single one of said slit (71) is formed to form two separate pieces (81, 83) and two elastic finger portions (101, 103).

3. An electrical connector contact element as claimed in claim 2, wherein two finger portions are equal to each other in the width within a region between said third end and a generally middle point from said third end to said V-shape curve, but one of said finger portions is smaller in its width than the other of said finger portions in the other region.

4. An electrical connector contact element as claimed in claim 1, wherein said elastic arm portion (55) is bent at a connection point with said fixing portion in a direction opposite to said C-shape curve, so that said elastic finger portions are positioned above said fixing portion.

5. An electrical connector comprising an insulator (230) fixing a contact element (51), said contact elements (51) being made of an electroconductive elastic plate and comprising a fixing portion (53) fixed to said insulator (230) and having a first end, an elastic portion (55, 57) with a second end connected to the first end of said fixing portion (53) and having a third end opposite to the second end, said elastic portion (55, 57) being formed with at least one slit (71) extending from said third end towards the second end to form a plurality of elastic finger portions (101, 103), and a plurality of contact points (91, 93) formed on said finger portions (101, 103), respectively, for coming into contact with a common mating contact element, wherein said plurality of elastic portions (101, 103) have widths, respectively, which are at least partially different from each other, wherein said elastic portion (55, 57) comprises:

an elastic arm portion (55) having said second end connected to said first end of said fixing portion (53) and being smoothly bent with a C-shape curve towards said fixing portion (53), said elastic arm portion (55) having a fourth end portion opposite to said second end thereof, said fourth end portion comprising a plurality of separate pieces (81, 83) separated by said at least one slit; and an elastic contact portion (57) comprising said elastic finger portions (101, 103) connected to said separate pieces (81, 83), respectively, said elastic contact portion (57) being smoothly bent with a U-shape curve in a direction opposite to said C-shape curve and being further bent with a V-shape curve in a direction of said U-shape curve, said contact points being formed on the V-shape curve.

* * * * *